US012496494B2

(12) United States Patent
Malm et al.

(10) Patent No.: US 12,496,494 B2
(45) Date of Patent: Dec. 16, 2025

(54) EXERCISE APPARATUS WITH CONTROL INTERFACES ON HANDLES

(71) Applicant: Johnson Health Tech. Co., Ltd., Taichung (TW)

(72) Inventors: Chad Malm, Monona, WI (US); Steven Hanson, Madison, WI (US); Donald Stiemke, Madison, WI (US); Alexander Hanson, Sun Prairie, WI (US); Megan Quinlan, Madison, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 309 days.

(21) Appl. No.: 18/123,935

(22) Filed: Mar. 20, 2023

(65) Prior Publication Data

US 2024/0316410 A1 Sep. 26, 2024

(51) Int. Cl.

| | |
|---|---|
| ***A63B 24/00*** | (2006.01) |
| ***A63B 22/00*** | (2006.01) |
| ***A63B 22/06*** | (2006.01) |
| ***A63B 71/06*** | (2006.01) |

(52) U.S. Cl.

CPC ..... *A63B 24/0087* (2013.01); *A63B 22/0023* (2013.01); *A63B 22/0605* (2013.01); *A63B 71/0619* (2013.01); *A63B 71/0622* (2013.01); *A63B 2071/065* (2013.01); *A63B 2071/0683* (2013.01)

(58) Field of Classification Search

CPC ..... A63B 24/0087; A63B 71/0619; A63B 71/0622; A63B 2071/065; A63B 2071/0625; A63B 2071/0658; A63B 2071/0683; A63B 22/0023; A63B 22/0605; A63B 2225/09; A63B 2225/20; A63B 2225/50; A63B 2230/06; A63B 2230/063; G05B 19/04; G06F 3/04847

See application file for complete search history.

(56) References Cited

U.S. PATENT DOCUMENTS

| | | | | |
|---|---|---|---|---|
| 10,252,141 | B2 * | 4/2019 | Chiang | A63B 24/0087 |
| 11,717,738 | B1 * | 8/2023 | Reader | G06F 1/3296 482/1 |
| 11,730,998 | B2 * | 8/2023 | Cernasov | A63B 21/0726 482/8 |
| 12,005,302 | B2 * | 6/2024 | Manzke | A63B 23/047 |
| 12,214,260 | B2 * | 2/2025 | Intonato | A63B 24/0062 |
| 2024/0226662 | A1 * | 7/2024 | Chamberlain | A63B 22/0605 |
| 2024/0278105 | A1 * | 8/2024 | Rickert | A63B 24/0087 |

* cited by examiner

*Primary Examiner* — Megan Anderson

(57) ABSTRACT

An exercise apparatus includes an exercise mechanism, a handle assembly, a display device, and a control unit. The exercise mechanism is provided for a user to perform an exercise. The handle assembly has at least one handle for the user to hold and a control interface mounted on an upper portion of the handle for allowing the user to control at least one operating parameter of the exercise apparatus. The display device is configured for displaying information to the user. The control unit is electrically connected to the control interface of the handle and configured to control the operating parameter of the exercise apparatus when receiving a command from the control interface. Specifically, the control interface is a touch screen for allowing the user to input the command to control the operating parameter of the exercise apparatus through the control interface.

19 Claims, 4 Drawing Sheets

EXERCISE APPARATUS WITH CONTROL INTERFACES ON HANDLES

BACKGROUND

1. Field of the Invention

The present invention relates to an exercise apparatus. More particularly, the present invention relates to an exercise apparatus with control interfaces on handles.

2. Description of the Related Art

In general, various exercise apparatuses such as treadmills, exercise bikes, elliptical machines, stair climbing machines, steppers, rower machines, weight training apparatuses, and other common exercise apparatuses have handlebars for allowing a user to grip during exercise. The handlebars according to their type and main function can be summarized into four categories: first, fixed handlebars for people to hold to stabilize the body to avoid falling, such as the handlebars at the front end or two sides of the treadmill or stair exerciser apparatus; second, fixed handlebars for people to grip to stabilize the upper body for supporting the movement of the lower body, such as the handlebar at front end of the upright bike, or the handlebars at two side of the seat of the recumbent bike; third, movable handlebars for allowing people to choose to grip during exercise for additional movement, such as most elliptical machines have movable handlebars that could be swingable forward and backward; fourth, movable handlebars for people to grip during exercise, such as the handlebar of the rower machine. Some exercise apparatuses may have two or more handle sets, for example, the recumbent bike generally has two fixed handle sets (disposed at a front of the bike and two sides of the seat), and the elliptical machine may have one fixed handle set and one movable handle set.

In the conventional exercise apparatuses, in addition to allowing the user to grip the handlebars during exercise, the handlebars can also be provided with control buttons for allowing the user to control operating parameters of the exercise apparatuses. The control buttons are generally mounted on the handlebars corresponding to the location of the user's thumbs for allowing the user to input commands. For example, the control buttons on the handlebars of the treadmill may be operable to control the inclination angle or the running speed of the treadmill belt. The control buttons on the handlebars of the elliptical machine may be operable to control the inclination angle of the pedal mechanism or the exercise resistance. The control buttons on the handlebars of the exercise bike may be operable to control the exercise resistance or other functions of the exercise bike. However, the above-mentioned control buttons on the handlebars of the conventional exercise apparatuses are generally physical control buttons that cannot be changed according to the requirements of the user. In other words, the buttons on a single handlebar can only adjust a single function.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The main object of the present invention provides an exercise apparatus, and its handles have touch screens integrated therein for replacing physical control buttons, so that the user is able to control the functions of the exercise apparatus via the touch screens of the handles.

According to one aspect of the present invention, an exercise apparatus includes an exercise mechanism for a user to perform an exercise, a handle assembly, a display device and a control unit. The handle assembly has at least one handle for the user to hold and a control interface mounted on an upper portion of the handle for allowing the user to control at least one operating parameter of the exercise apparatus. The display device is configured for displaying information to the user. The control unit is electrically connected to the control interface of the handle. The control unit is configured to control the operating parameter of the exercise apparatus when receiving a command from the control interface. Specifically, the control interface is a touch screen for allowing the user to input the command to control the operating parameter of the exercise apparatus through the control interface.

Preferably, the control interface of the handle is in communication with the display device so that the control interface is capable of controlling functions of the display device, displaying information relating to a control signal provided on the display device, controlling the selection of video content displayed on the display device, or controlling volume output of the display device. Moreover, the control interface is able to graphically display timer information provided on the display device.

Preferably, the control interface of the handle is configured to provide two or more display pages for allowing the user to switch, and each display page represents an operating interface for controlling a particular operating parameter of the exercise apparatus or an operating interface for controlling the display device. Thus, the control interface of the handle can control two or more operating parameters of the exercise apparatus.

Preferably, the exercise apparatus further comprises a difficulty changing device configured to change difficulty level of the exercise mechanism for the user to perform the exercise. The difficulty changing device is electrically connected to the control unit, so that the user is capable of changing difficulty level of the exercise through the control interface of the handle. Specifically, the difficulty changing device comprises a resistance device configured to apply a predetermined resistance to the exercise mechanism and the user is capable of adjusting the resistance to the exercise mechanism.

Preferably, the exercise apparatus further comprises an inclination adjusting mechanism coupled to the exercise mechanism for adjusting an inclination angle of the exercise mechanism. The inclination adjusting mechanism is electrically connected to the control unit, so that the user is capable of controlling the inclination angle of the exercise mechanism through the control interface of the handle.

Preferably, the control interface is operable to display physiological information of the user during the exercise. For example, the handle of the handle assembly has a grip portion and a heart rate sensor disposed on the grip portion of the handle for detecting a heart rate of the user.

Preferably, the control interface of the handle is provided for allowing the user to input commands of stopping, resuming or ending the exercise, or select an exercise program.

Preferably, the control interface has a user authentication unit configured for personal validation, so that the user is capable of pairing with the exercise apparatus and obtaining workout data from the exercise apparatus.

Further benefits and advantages of the present invention will become apparent after a careful reading of the detailed description with appropriate reference to the accompanying drawings.

DETAIL DESCRIPTION

Figure 1:
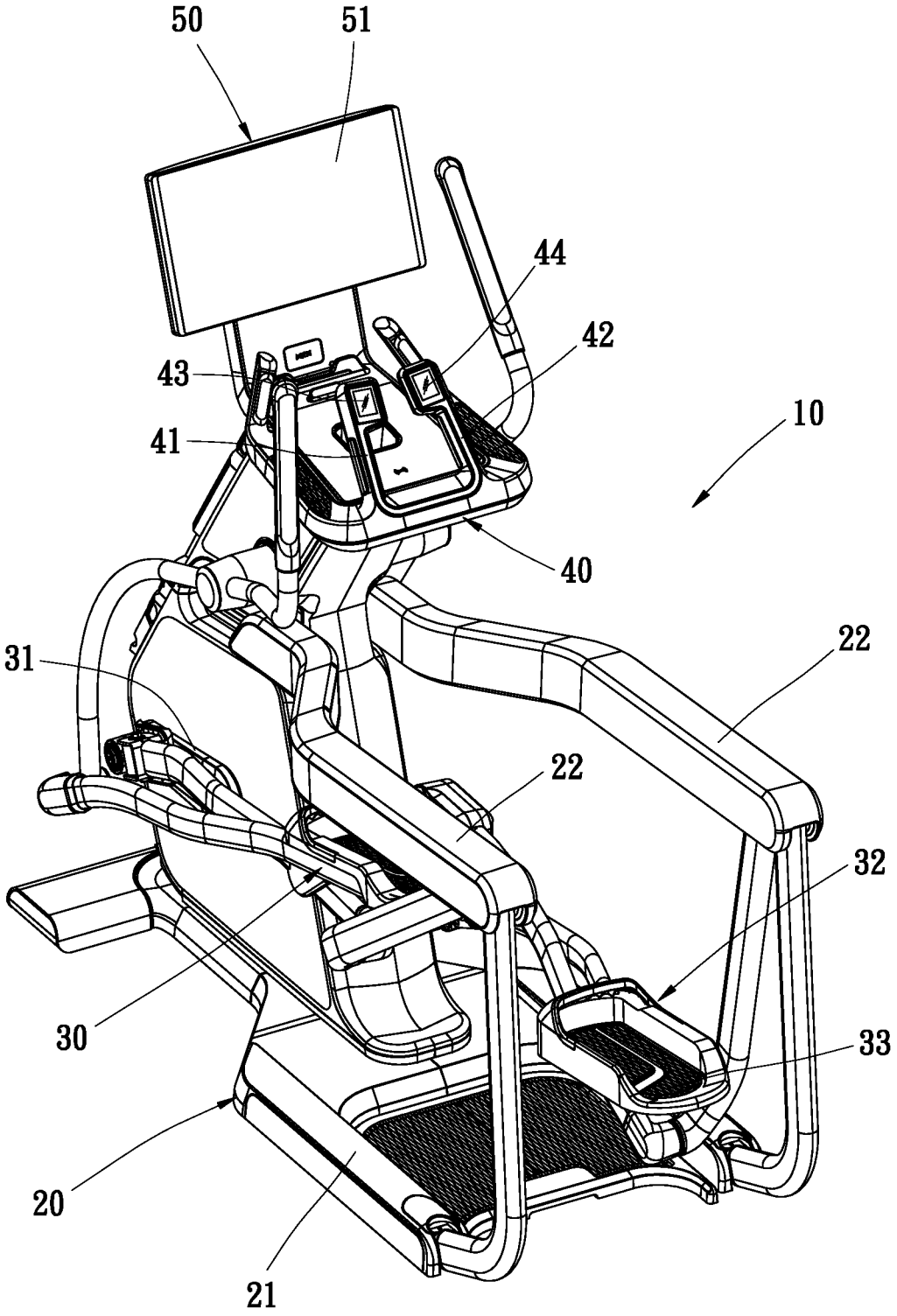
FIG. 1 is a perspective view of an exercise apparatus in accordance with a preferred embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

The present invention provides a handle assembly with compact touch screens, which can be applied to various exercise apparatuses having handlebars, such as electric treadmills, exercise bikes (including upright bike and recumbent bike), elliptical machines, stair climbing machines, steppers, rower machines, weight training machines and other common exercise apparatuses, and other special type exercise apparatuses but used in the same field, such as cross trainers, horse riding machines, or particular brands of "Tread Climber", "Adaptive Motion Trainer", "Arc Trainer", or the like. However, the invention could also be applied to other exercise apparatuses which are not listed. In addition to cardio function apparatuses and weight training apparatuses, the present invention could also be applied to passive exercise apparatuses without active power by a user, such as a motor-driven revolving pedal rehabilitation indoor bike.

The aforementioned exercise apparatuses have respective exercise mechanisms or movable elements for a purpose of executing specific exercises. For example, a treadmill has a running belt for allowing a user to perform an exercise of running or walking, an indoor bike or an elliptical machine has a pedal mechanism for allowing a user to perform an exercise of pedaling, a stair climbing machine has a stair mechanism for allowing a user to perform an exercise of stair climbing, or the like. Such exercise mechanism of each apparatus is the technological background of the art, and it will not be described in detail in this specification.

The exercise apparatus suitable for the present invention has at least one handle assembly for allowing the user to hold during exercise. For example, the fixed handlebars at the front end of the treadmill, or the fixed handlebars at the upper front of the stair climbing machine, which allow the user to grip during exercise of walking, jogging or stair climbing. The fixed handlebars at the front end of the upright and recumbent bike, the fixed handlebars at two sides of the seat of the recumbent bike, or the fixed handlebars at the front end of the elliptical machine, which allow the user to grip during exercise. In the preferred embodiment of the present invention, the touch screens can be integrated in the aforementioned fixed handlebars for replacing physical control buttons. In another embodiment, the touch screens can also be mounted on movable handlebars, such as the movable handlebars at the front of the elliptical machine for allowing the user to grip during leg exercise to accompany push-pull motion of the user's hands, or the movable handlebar of the rower machine for allowing the user to grip during rowing exercise. The exercise apparatuses suitable for the present invention may have two or more sets of identical or different functional handlebars. For example, the recumbent bike has two sets of fixed handlebars respectively mounted at the front end of the bike and the two sides of the seat, and the elliptical machine has one set of fixed handlebar and one set of movable handlebar.

FIG. 1 depicts an appearance of an exercise apparatus 10 in accordance with a preferred embodiment of the present invention. The exercise apparatus 10 comprises a frame 20, an exercise mechanism 30, a handle assembly 40 for being gripped by the user during exercise, and a console 50 as a human-machine interface. The exercise mechanism 10 has a movable element being movable during performance of a particular exercise by a user. As shown in FIG. 1, the exercise apparatus 10 of the present invention is based on an elliptical machine. Accordingly, the exercise mechanism 30 includes a pedal mechanism for allowing a user to perform elliptical workout. The handle assembly 40 is mounted on the top of the frame 20, so that the handle assembly 40 is located at the upper front of the exercise apparatus 10 for allowing the user to reach their hands forward to grip the handle assembly 40 while performing elliptical movement. The console 50 is also mounted on the top of the frame 20 and coupled to the handle assembly 40 for allowing the user to interact with the exercise apparatus 10.

Figure 2:
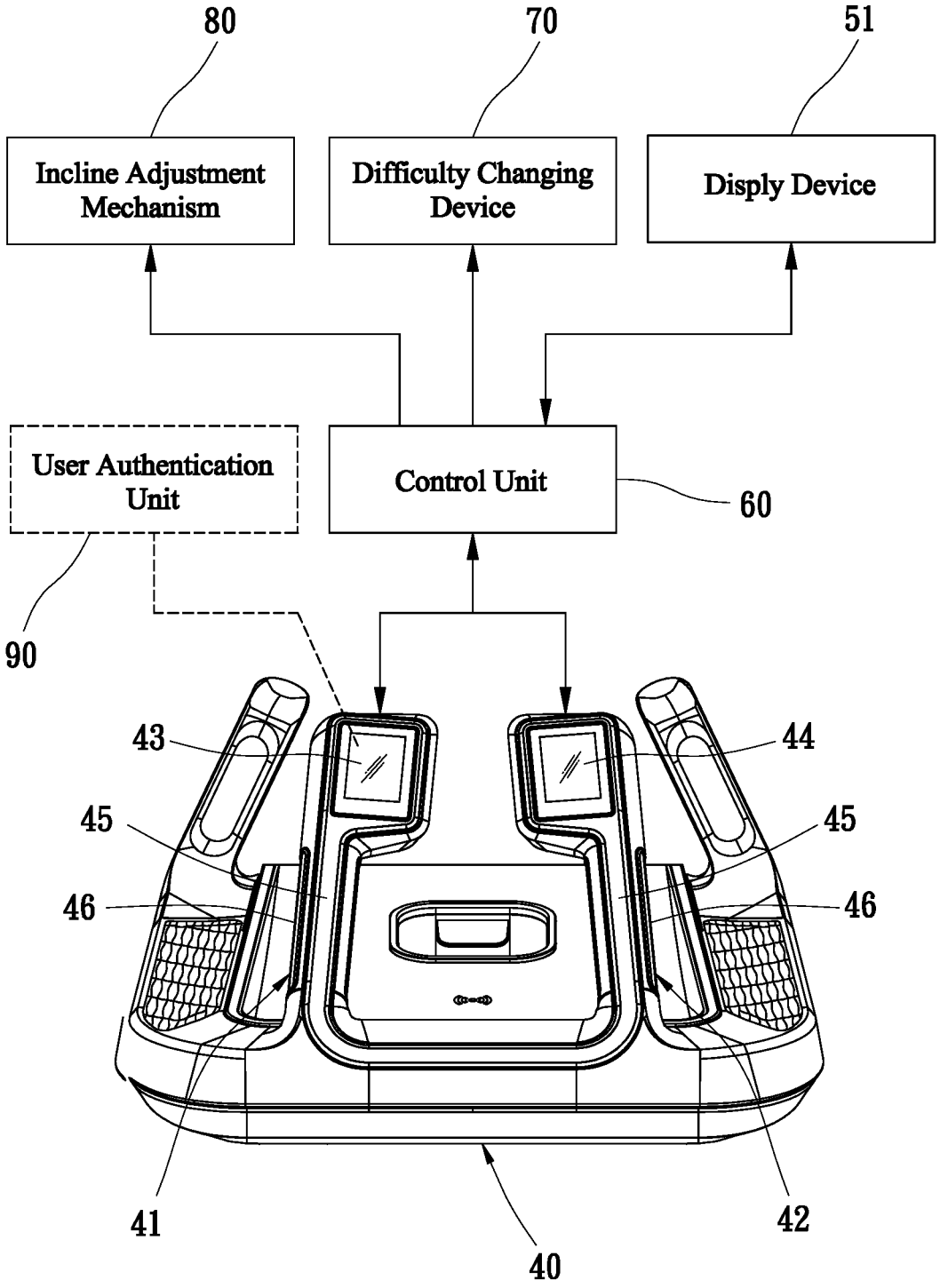
FIG. 2 is a schematic diagram illustrating electrical functions of a handle assembly of the preferred embodiment of the present invention.

Referring to FIG. 2, the handle assembly 40 has a pair of operation handles for allowing the user to grip with two hands when performing the exercise. The operation handles includes a first operation handle 41 and a second operation handle 42 which are arranged symmetrically. In the preferred embodiment of the present invention, the two operation handles 41, 42 are arranged at the rear end of the handle assembly 40 and forming a substantially U-shaped configuration. Specifically, each of the two operation handles 41, 42 has a compact screen disposed on one end of the respective operation handle. In the preferred embodiment of the present invention, the first operation handle 41 has a first screen disposed on its upper portion, forming a first control interface 43. The second operation handle 42 has a second screen disposed on its upper portion, forming a second control interface 44. Both the first control interface 43 and the second control interface 44 are touch screens for allowing the user to input commands to control operating parameters of the exercise apparatus 10 through the first control interface 43 and/or the second control interface 44. For example, the first control interface 43 and the second control interface 44 may provide simulated buttons corresponding to the location of the user's thumbs for allowing the user to input commands to control the operating parameters of the exercise apparatus 10. Furthermore, the two operation handles 41, 42 each has a grip portion 45 for allowing the user to grip during exercise and a heart rate sensor 46 disposed on the grip portion 45 of the respective operation handle 41/42 for detecting the heart rate of the user. In the preferred embodiment, the two control interfaces 43, 44 can be operable to display physiological information (e.g. heart rate) of the user during the exercise.

Incidentally, the handle assembly 40 may have a second pair of handle at the front end of the handle assembly 40 as assist handles so that the user can choose to grip the first pair of operation handles or the second pair of assist handles or not, depending on requirements at any time during exercise, but it is not limited in the present invention. In fact, most exercise apparatuses may have only one pair of handles for allowing the user to grip.

As shown in FIG. 2, the first control interface 43 and the second control interface 44 are electrically connected to a control unit 60. The control unit 60 is configured to receive and process the commands from the two control interfaces 43, 44 to control operating parameters of the exercise apparatus 10 when receiving commands from the user. In the preferred embodiment of the present invention, the control unit 60 includes a microcontroller unit (MCU), at least one electronic circuit, and at least one circuit board. In another embodiment, the control unit 60 can be a computer processing system that includes a hardware assembly, a software assembly, and/or a firmware assembly, which could process electrical signals from the two control interfaces 43, 44 in a predetermined way.

The console 50 has a display device 51 for displaying information to the user such as LCD (liquid crystal display) or LED (light-emitting diode) display devices. The display device 51 is provided to display a wide variety of information, including but not limited to a user's workout program, the current speed of the exercise mechanism 30, the distance a user has traveled on the exercise apparatus 10, the time a user has been working out, body functions (e.g., heart rate) of a user, resistance levels of the exercise mechanism 30, energy expended, etc. In addition to workout information, the display device 51 may be used to display video content, such as digital video, cable or over-the-air television, music videos, news, movie, and/or training videos during a workout by the user. In certain embodiments, both video content and workout information may be displayed simultaneously or a user can switch therebetween.

In the preferred embodiment of the present invention, the display device 51 is electrically connected to the control unit 60, so that the display device 51 can be intercommunicated with the first control interface 43 and the second control interface 44. Therefore, the first control interface 43 and/or the second control interface 44 are capable of providing input options for controlling functions of the display device 51 so as to control the selection of video content, volume output, etc. Moreover, some information or signals displayed on the display device 51 can be displayed on the one or two control interfaces 43, 44, such as the timer information can be displayed on the two control interfaces 43, 44.

Referring to FIG. 1 and FIG. 2, the exercise mechanism 30 of the exercise apparatus 10 includes a crank mechanism 31 mounted on the frame 20, and a pedal mechanism 32 coupled to the crank mechanism 31, such that rotation of the crank mechanism 31 will drive the pedal mechanism 32 to move in a predetermined path. In the preferred embodiment, the exercise apparatus 10 has a difficulty changing device 70 configured to change difficulty level of the exercise mechanism 30. The difficulty changing device 70 is electrically connected to the control unit 60, so that the control unit 60 is able to control the difficulty changing device 70 immediately according to a command for a requirement of difficulty that is inputted by the user via the first control interface 43 or the second control interface 44 (e.g. requirements for difficulty increasing or decreasing, or requirements for a specific level), or control the difficulty changing device 70 sequentially according to an exercise program which includes a time setting item and a difficulty setting item to change difficulty level of the exercise mechanism 30 during exercise. The control unit 60 is able to control the display device 51 to show the difficulty information of the exercise.

In the case of elliptical machines as shown in FIG. 1, the difficulty changing device 70 is a resistance device which could apply a predetermined resistance to the exercise mechanism 30 (including crank mechanism 31 and pedal mechanism 32). For example, the aforementioned resistance device may include, but not limited to, an eddy current brake (ECB), a generator brake, a friction brake, a water resistance device, or a wind resistance device for generating a resistance. The difficulty or intensity of the pedaling exercise is increased or decreased while the resistance is increased or decreased. Thereby, it is able to set the force required for driving the exercise mechanism 30, namely to set a difficulty level of the exercise movement. In the case of other exercise apparatus, for example, the difficulty changing device of treadmills for running or walking is generally a driving device for driving the running belt to rotate in a predetermined speed or driving the treadmill platform to change its inclination angle. The difficulty or intensity of the running or walking exercise is increased or decreased while the belt speed or the inclination angle is increased or decreased. Further, the difficulty changing device of the stair exerciser apparatus is generally a resistance device which could apply predetermined resistance to the stair mechanism. When the resistance applied to the stair exerciser apparatus is increased or decreased, the downward speed of the stairs is decreased or increased so as to decrease or increase the difficulty or intensity of the climbing exercise, and so on. However, the structure and operation of the resistance device are conventional techniques that are well known in the art, and the detailed description is not mentioned in the present invention.

Referring to FIG. 1, the pedal mechanism 32 has two pedals 33 that can be driven to move along a closed path during the rotation of the crank mechanism 31. In the preferred embodiment of the present invention, the closed path of the two pedals 33 can be adjusted via an incline adjustment mechanism 80. Referring to the elliptical machine shown in FIG. 1, the frame 20 includes a stationary frame 21 and a supporting frame 22 which can be adjusted with respect to the stationary frame 21. The pedal mechanism 32 is supported by the supporting frame 22, such that the two pedals 33 of the pedal mechanism 32 can be movable along the closed path. The supporting frame 22 can be adjusted by the incline adjustment mechanism 80 to move forward or backward to change the incline angle of the closed path. For example, as shown in FIG. 1, the front end of the supporting frame 22 can be adjusted by the incline adjustment mechanism 80 to move forward to decrease the incline angle of the closed path or move backward to increase the incline angle of the closed path, so that the movement path of the two pedals 33 of the exercise mechanism 30 can be changed for providing various exercise paths to the user.

In the preferred embodiment of the present invention, the two control interfaces 43, 44 of the handle assembly 40 are provided for allowing the user to interact with the exercise apparatus 10. FIG. 2 schematically illustrates electrical functions of the handle assembly 40. The first control interface 43 and the second control interface 44 are interconnected to the control unit 60, and the control unit 60 is electrically connected to the display device 51, the difficulty changing device 70, and the incline adjusting mechanism 80, so that the first control interface 43 and/or the second control interface 44 can be operable to control the functions of the display device 51, the difficulty level (e.g. the resistance level) of the exercise movement, and the inclination angle of the exercise path.

Referring to FIG. 2, one of the two control interfaces 43, 44 has a user authentication unit 90 configured for personal validation. For example, the first control interface 43 can be coupled to the user authentication unit 90 for allowing the user to pair with the exercise apparatus 10, so that the user is able to obtain workout data from the exercise apparatus 10. In the preferred embodiment of the present invention, the user authentication unit 90 has a memory, a processor, and wireless communication circuitry such as RFID, NFC, Bluetooth, and WiFi to perform the necessary communication functions. The user can connect their wearable device (e.g. smartwatch) to the exercise apparatus 10 by placing the wearable device close to the first control interface 43 of the first operation handle 41, so that the wireless communication circuitry of the user authentication unit 90 can detect the wearable device (e.g. NFC proximity of Apple Watch like Apple Gymkit which allows users to be able to use their Apple Watch to pair and sync data with compatible workout equipment). The user can also pair other wireless devices (e.g. smartphone) with the exercise apparatus 10 via the two control interfaces 43, 44, so that the wireless devices can be in communication with the exercise apparatus 10 for receiving the workout information.

In the preferred embodiment of the present invention, the user can control the exercise apparatus 10 through the first control interface 43 and the second control interface 44. The first and second control interfaces 43, 44 are capable of graphically displaying functions or exercise information to the user, and graphical user interfaces (GUIs) can be provided to facilitate user interaction with the exercise apparatus 10. The GUIs on the first control interface 43 and the second control interface 44 may allow the user to change settings of the exercise apparatus 10, select/browse various exercise programs, and/or change settings during a workout. For example, FIG. 3 to FIG. 9*b* show exemplary GUIs displayed on the first control interface 43 and/or the second control interface 44. The GUIs may support touch commands so that the user is able to input options such as "start workout", "pause workout", "resume workout", "end workout", and/or adjusting workout level, controlling functions of the display device 51.

Figure 3:
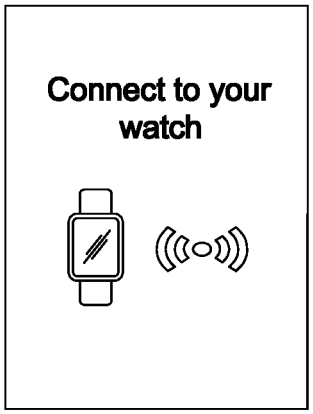
FIG. 3 to FIG. 9*b* show exemplary GUIs displayed on a first control interface and/or a second control interface of operation handles.
Figure 4:
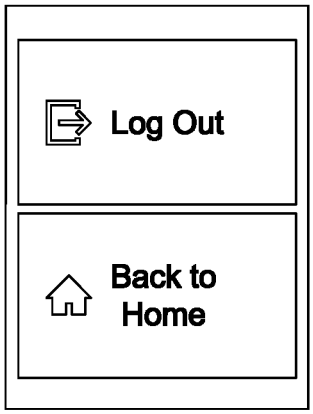
Figure 5:
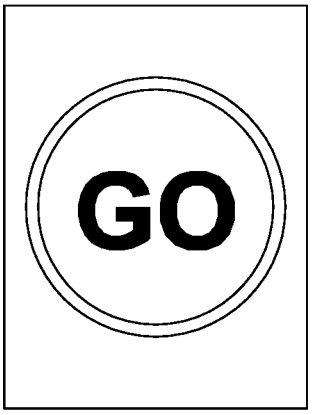
Figure 6:
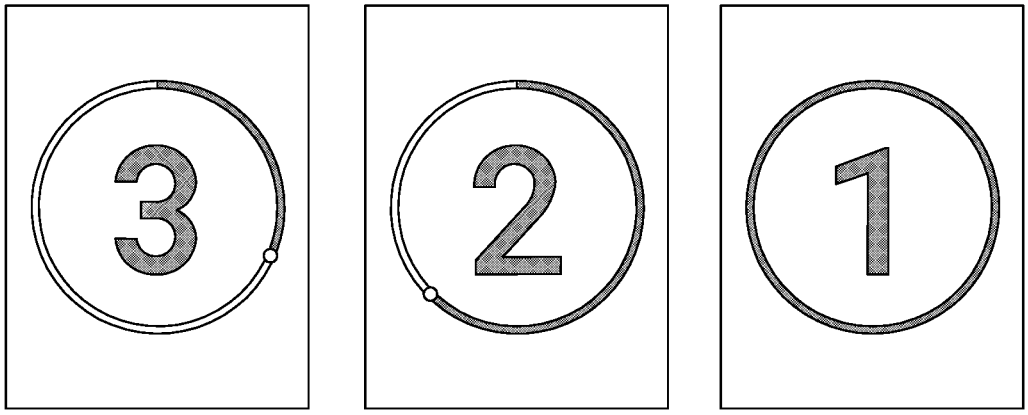
Figure 7A:
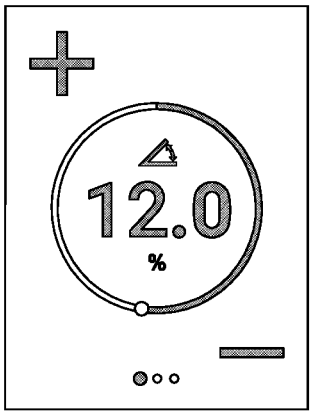
Figure 7B:
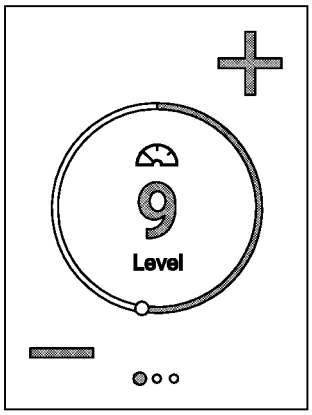

As mentioned above, the first control interface 43 may be coupled to the user authentication unit 90 for personal validation, and the first control interface 43 may provide guidance to the user. For example, FIG. 3 shows that the first control interface 43 may display a message that the user can pair with the exercise apparatus 10 via their smartwatch. FIG. 4 shows that the second control interface 44 may provide options for allowing the user to "log out" or "back to home" (e.g. go back to the home screen). Referring to FIG. 5, the user can start a workout by touching "GO" button on the first control interface 43 and/or the second control interface 44. When the user touches "GO" button to start a new workout, the first control interface 43 and/or the second control interface 44 may graphically display timer information (e.g. countdown signals) to the user, as shown in FIG. 6. Referring to FIG. 7*a*, the GUI on the first control interface 43 may display the inclination information of the exercise mechanism 30 and allow the user to adjust the inclination angle of the exercise mechanism 30. For example, FIG. 7*a* shows that the current inclination of the exercise mechanism 30 is 12% grade, and the user can touch "+" button to increase the inclination angle of the exercise mechanism 30 or touch "−" button to decrease the inclination angle of the exercise mechanism 30. Referring to FIG. 7*b*, the GUI on the second control interface 44 may display the difficulty level of the exercise mechanism 30 and allow the user to adjust the difficulty level of the exercise mechanism 30. For example, FIG. 7*b* shows that the current difficulty level of the exercise mechanism 30 is level 9, and the user can touch "+" button to increase the difficulty level of the exercise mechanism 30 or touch "−" button to decrease the difficulty level of the exercise mechanism 30.

Figure 8A:
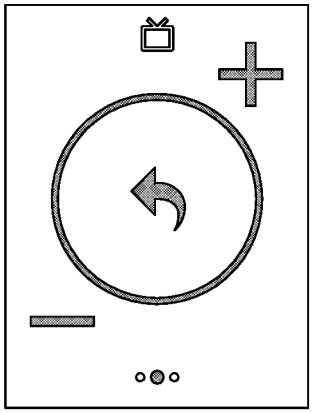
Figure 8B:
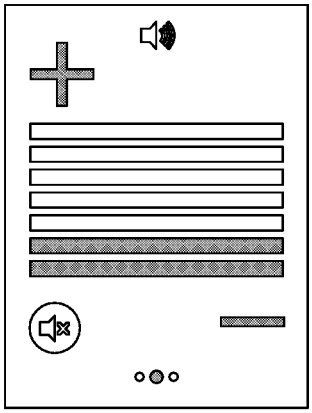
Figure 9A:
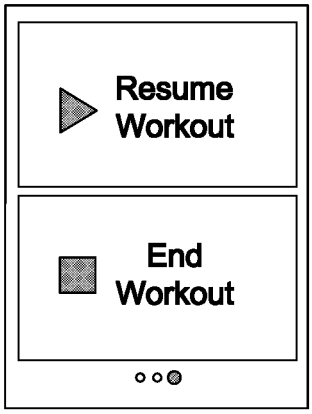
Figure 9B:
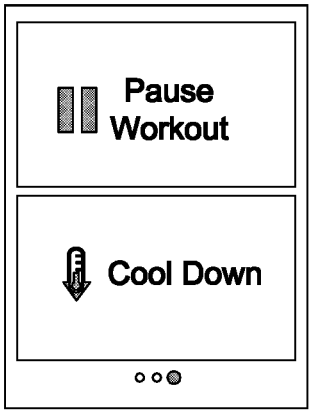

In the preferred embodiment of the present invention, the first control interface 43 and the second control interface 44 may be interconnected to the display device 51, so that the first control interface 43 and the second control interface 44 can provide input options for controlling functions of the display device 51. For example, the GUI on the first control interface 43 may be provided for allowing the user to control selection of video content. As shown in FIG. 8*a*, the GUI on the first control interface 43 allows for channel selection on the integrated console TV, so that the user can touch "+" button for channel up or touch "−" button for channel down. Referring to FIG. 8*b*, the GUI on the second control interface 44 may be provided for allowing the user to adjust the volume output of the display device 51. The user can touch "+" button to increase the volume output or touch "−" button to decrease the volume output of the display device 51. Referring to FIG. 9*a* and FIG. 9*b*, the GUI on the first control interface 43 and/or the second control interface 44 may be provided for allowing the user to input options of "resume workout", "end workout", or "pause workout". In addition, the GUI may also allow the user to select/browse various exercise programs such as cool down program. In another embodiment, the background color of the two control interfaces may be changed according to various exercise programs, exercise intensity, operation modes, user status, etc. It should be noted that the foregoing GUIs on the two control interfaces 43, 44 are merely for illustrative purposes, not limited in the present invention.

In the preferred embodiment of the present invention, both the first control interface 43 of the first operation handle 41 and the second control interface 44 of the second operation handle 42 can provide two or more display pages for allowing the user to switch with their thumbs. Each display page represents an operating interface for controlling a particular operating parameter of the exercise apparatus 10 or an operating interface for controlling the display device 51. For example, but not limited to, the first control interface 43 may provide three display pages for allowing the user to choose, such as a first display page for inclination adjustment (as shown in FIG. 7*a*), a second display page for TV channel selection (as shown in FIG. 8*a*), or a third page for operations of resume/end workout (as shown in FIG. 9*a*). The second control interface 44 may also provide three display pages for allowing the user to choose, such as a first display page for difficulty level adjustment (as shown in FIG. 7*b*), a second display page for volume output adjustment (as shown in FIG. 8*b*), or a third page for operations of pause workout or program selection (as shown in FIG. 9*b*). Accordingly, the control interfaces on the operation handles are convenient for the user to control functions or operating parameters of the exercise apparatus.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

an exercise mechanism for a user to perform an exercise;

a handle assembly having at least one handle for the user to hold and a control interface mounted on an upper portion of the at least one handle for allowing the user to control at least one operating parameter of the exercise apparatus;

a display device for displaying information to the user; and a control unit electrically connected to the control interface of the at least one handle, the control unit configured to control the at least one operating parameter of the exercise apparatus when receiving a command from the control interface;

wherein the control interface is a touch screen for allowing the user to input the command to control the at least one operating parameter of the exercise apparatus through the control interface.

2. The exercise apparatus as claimed in claim 1, wherein the control interface of the at least one handle is in communication with the display device so that the control interface is capable of controlling the display device.

3. The exercise apparatus as claimed in claim 2, wherein the control interface of the at least one handle is operable to display information relating to a control signal provided on the display device.

4. The exercise apparatus as claimed in claim 2, wherein the control interface of the at least one handle is operable to provide input options for controlling at least one function of the display device.

5. The exercise apparatus as claimed in claim 2, wherein the control interface of the at least one handle is operable to control selection of video content displayed on the display device and/or control volume output of the display device.

6. The exercise apparatus as claimed in claim 1, wherein the control interface is configured to graphically display timer information provided on the display device.

7. The exercise apparatus as claimed in claim 1, further comprising a difficulty changing device configured to change difficulty level of the exercise mechanism for the user to perform the exercise, wherein the difficulty changing device is electrically connected to the control unit, so that the user is capable of changing difficulty level of the exercise through the control interface of the at least one handle.

8. The exercise apparatus as claimed in claim 7, wherein the difficulty changing device comprises a resistance device configured to apply a predetermined resistance to the exercise mechanism and the user is capable of adjusting the resistance to the exercise mechanism through the control interface of the at least one handle.

9. The exercise apparatus as claimed in claim 1, wherein the control interface is operable to display physiological information of the user during the exercise.

10. The exercise apparatus as claimed in claim 9, wherein the at least one handle of the handle assembly has a grip portion and a heart rate sensor disposed on the grip portion of the at least one handle for detecting a heart rate of the user.

11. The exercise apparatus as claimed in claim 1, wherein the control interface has a user authentication unit configured for personal validation, so that the user is capable of pairing with the exercise apparatus and obtaining workout data from the exercise apparatus.

12. The exercise apparatus as claimed in claim 11, wherein the control interface is provided for allowing the user to pair a wireless device with the exercise apparatus, so that the wireless device is in communication with the exercise apparatus.

13. The exercise apparatus as claimed in claim 1, wherein the control interface of the at least one handle is operable to control a plurality of the operating parameters of the exercise apparatus.

14. The exercise apparatus as claimed in claim 1, wherein the control interface of the at least one handle is configured to provide two or more display pages for allowing the user to switch, and each display page represents an operating interface for controlling a particular one of the at least one operating parameter of the exercise apparatus or an operating interface for controlling the display device.

15. The exercise apparatus as claimed in claim 1, wherein the control interface of the at least one handle is provided for allowing the user to input commands of stopping, resuming, or ending the exercise.

16. The exercise apparatus as claimed in claim 1, wherein the control interface of the at least one handle is provided for allowing the user to select an exercise program which includes a time setting item and a difficulty setting item for the exercise.

17. An exercise apparatus, comprising:

an exercise mechanism having a movable element being movable during performance of an exercise by a user;

a handle assembly having a first handle and a second handle for the user to hold, the first handle having a first control interface mounted on an upper portion thereof, the second handle having a second control interface mounted on an upper portion thereof, the first control interface being operable for the user to control a first set of operating parameters of the exercise apparatus, the second control interface being operable for the user to control a second set of operating parameters of the exercise apparatus;

a display device configured for displaying information to the user; and a control unit electrically connected to the first control interface and the second control interface, the control unit configured to control the first set of operating parameters of the exercise apparatus when receiving a command from the first control interface or to control the second set of operating parameters of the exercise apparatus when receiving a command from the second control interface;

wherein both the first control interface and the second control interface are touch screens for allowing the use to input the command to control the operating parameter of the exercise apparatus.

18. The exercise apparatus as claimed in claim 17, wherein the first and second control interfaces are in communication with the display device, so that the first and second control interfaces are capable of controlling functions of the display device and displaying information on the display device.

19. The exercise apparatus as claimed in claim 17, wherein the first and second control interfaces are capable of graphically displaying exercise information to the user.

* * * * *